US005254039A

United States Patent [19]

Garcia

[11] Patent Number: 5,254,039

[45] Date of Patent: Oct. 19, 1993

[54] PLAYGROUND CONSTRUCTION

[76] Inventor: Juan Garcia, 13335 Little Morongo Rd., Desert Hot Springs, Calif. 92240

[21] Appl. No.: 942,788

[22] Filed: Sep. 10, 1992

[51] Int. Cl.[5] ..... E04F 15/16; A63C 19/04

[52] U.S. Cl. ..... 472/92; 52/225; 52/2.18; 454/284; 5/420

[58] Field of Search ..... 472/92, 85, 86; 52/2.11, 2.13, 2.18, 2.22, 2.23, 2.25; 454/284, 296, 370; 5/449, 420; 273/411, 1.5 R, 55 R

[56] References Cited

U.S. PATENT DOCUMENTS

| | | | |
|---|---|---|---|
| D. 300,194 | 3/1989 | Walker | D6/605 |
| 2,748,399 | 6/1956 | Rockoff | 5/449 |
| 3,234,741 | 2/1966 | Ionides | 52/2.19 |
| 4,462,184 | 7/1984 | Cunningham | 472/92 |
| 4,472,472 | 9/1984 | Schultz | 5/420 |
| 4,516,767 | 5/1985 | Eskijian | 5/420 |
| 4,557,475 | 12/1985 | Donovan | 52/177 |
| 4,846,457 | 7/1989 | Vaux | 472/92 |
| 5,030,390 | 7/1991 | Nicholls et al. | 52/2.25 |

FOREIGN PATENT DOCUMENTS

| | | | |
|---|---|---|---|
| 2612793 | 9/1988 | France | 472/92 |

*Primary Examiner*—Carl D. Friedman
*Assistant Examiner*—Winnie Yip
*Attorney, Agent, or Firm*—Richard L. Miller

[57] ABSTRACT

An improved playground construction is provided and consists of inflatable dome-shaped ribs placed one next to each other on a layer of padding on a hard ground surface of a playing field. Filler material is placed between the tops of the ribs with a strip of artificial grass placed over the filler material and the tops of the ribs. A mechanism conveys compressed air into the ribs, so that they will inflate to help cushion the fall of players and reduce injury, while giving more spring and bounce to the strip of artificial grass for running players. Air exhaust tubes extend upwardly from an apex of the inflatable dome-shaped ribs and through the strip of artificial grass to allow air to exit therethrough.

4 Claims, 1 Drawing Sheet

PLAYGROUND CONSTRUCTION

BACKGROUND OF THE INVENTION

The instant invention relates generally to cushioned surfaces and more specifically it relates to an improved playground construction.

Numerous cushioned surfaces have been provided in the prior art that are adapted to be fabricated out of resilient layered materials to protect people from hard surfaces. For example, U.S. Pat. Nos. 4,516,767 to Eskijian; 4,557,475 to Donovan and Des. 300,194 to Walker all are illustrative of such prior art. While these units may be suitable for the particular purpose to which they address, they would not be as suitable for the purpose of the present invention as hereafter described.

SUMMARY OF THE INVENTION

A primary object of the present invention is to provide an improved playground construction that will overcome the shortcomings of the prior art devices.

Another object is to provide an improved playground construction in which inflatable dome-shaped ribs are located below a layer of artificial grass on a playing field, so as to cushion the fall of players to reduce injury.

An additional object is to provide an improved playground construction in which compressed air used to fill the inflatable dome-shaped ribs below will give more spring and bounce to the artificial grass above, for running players, so as to make a better playing surface.

A further object is to provide an improved playground construction that is simple and easy to use.

A still further object is to provide an improved playground construction that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
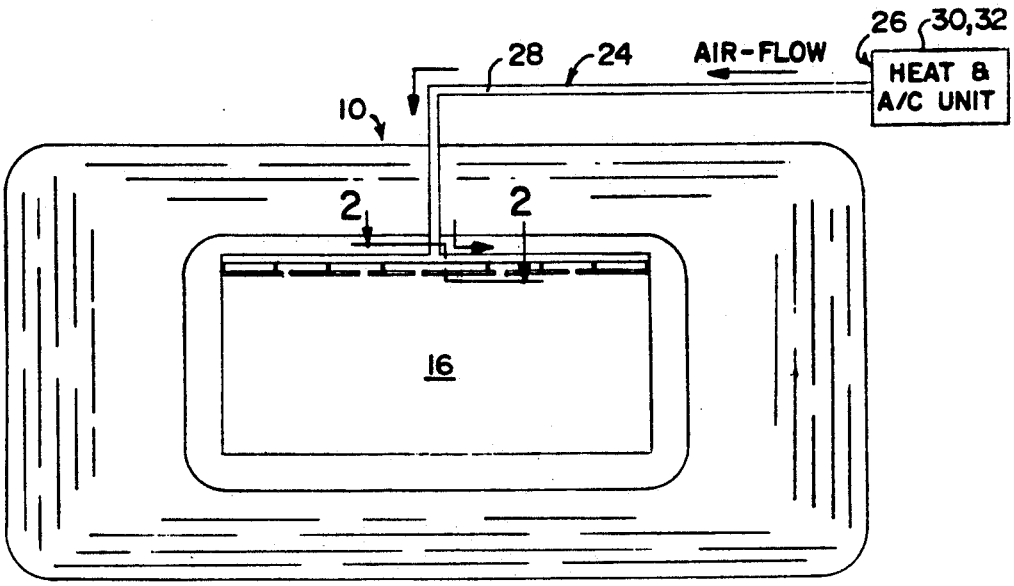
FIG. 1 is a diagrammatic plan view illustrating the instant invention installed in a typical sports playing field.
Figure 2:
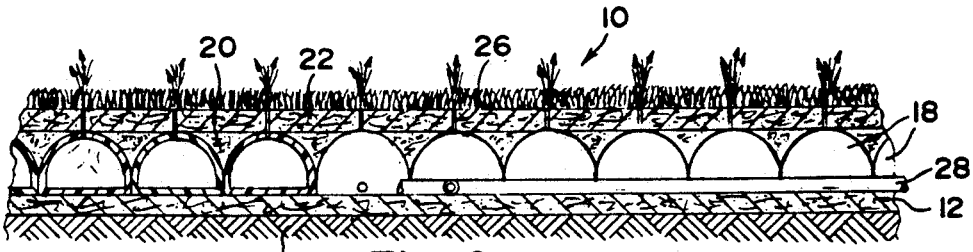
FIG. 2 is a greatly enlarged cross sectional view taken on line 2—2 of FIG. 1.
Figure 3:
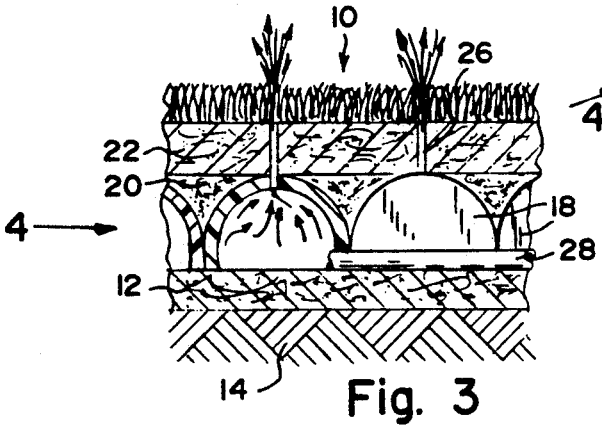
FIG. 3 is a still further enlarged cross sectional view similar to FIG. 2 with more parts broken away.
Figure 5:
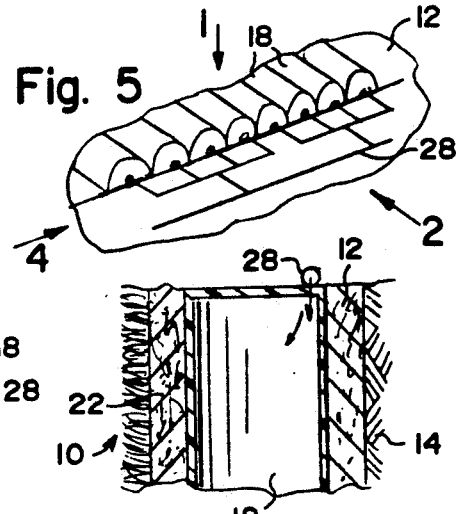
FIG. 5 is a diagrammatic perspective view with parts broken away.
Figure 4:
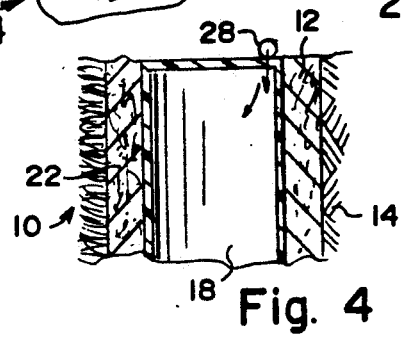
FIG. 4 is a still further enlarged sectional view taken in the direction of arrow 4 in FIG. 3.

Turning now descriptively to the drawings, in which similar reference characters denote similar elements throughout the several views, the Figures illustrate an improved playground construction 10, which consists of a layer of padding 12 placed upon a hard ground surface 14 of a playing field 16. A plurality of inflatable dome-shaped ribs 18 are placed one next to each other on the layer of padding 12 which extend transversely to the length of the playing field 16. A filler material 20 is placed between the tops of the ribs 18, so as to form a flat surface thereacross. A strip of artificial grass 22 is placed upon the flat surface of the filler material 22 and the tops of the ribs 18. A mechanism 24 is for conveying compressed air into the ribs 18. The ribs 18 will inflate to help cushion the fall of players and reduce injury, while giving more spring and bounce to the strip of artificial grass 22 for running players.

A plurality of air exhaust tubes 26 are also provided to extend upwardly from an apex of the inflatable dome-shaped ribs 18 and through the strip of artificial grass 22. When the strip of artificial grass 22 gets wet with water, air exiting through the exhaust tubes 26 will help push the water off the playing field 16 and dry the strip of artificial grass 22.

The compressed air conveying mechanism 24 consists of a remote air compressor 26 and a network of piping 28 between remote air compressor 26 and the inflatable dome-shaped ribs 18.

The air compressor 26 contains a combination heating unit 30 and air conditioning unit 32 coupled thereto. During a winter season the heating unit 30 can be activated to allow hot air to exit through the exhaust tubes 26 to keep the players warm and to melt ice and snow from the strip of artificial grass 22. During a summer season the air conditioning unit 32 can be activated to allow cold air to exit through the exhaust tubes 26 to keep the players cool.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved playground construction which comprises:

a) a layer of padding placed upon a hard ground surface of a playing field;

b) a plurality of inflatable dome-shaped ribs placed one next to each other on said layer of padding which extend transversely to the length of the playing field;

c) a filler material placed between the tops of said ribs, so as to form a flat surface thereacross;

d) a strip of artificial grass placed upon the flat surface of said filler material and the tops of said ribs; and e) means for conveying compressed air into said ribs, so that said ribs will inflate to help cushion the fall of players and reduce injury, while giving more spring and bounce to said strip of artificial grass for running players.

2. An improved playground construction as recited in claim 1, further including a plurality of air exhaust tubes, extending upwardly from an apex of said inflatable dome-shaped rib and through said strip of artificial grass, so that when said strip of artificial grass gets wet with water, air exiting through said exhaust tubes will help push the water off the playing field and dry said strip of artificial grass.

3. An improved playground construction as recited in claim 2, wherein said compressed air conveying means includes:

a) a remote aire compressor; and b) a network of piping between said remote air compressor and said inflatable dome-shaped ribs.

4. An improved playground construction as recited in claim 3, wherein said air compressor includes a combination heating unit and air conditioning unit coupled thereto, so that during a winter season said heating unit can be activated to allow hot air to exit through said exhaust tubes to keep the players warm and to melt ice and snow from said strip of artificial grass, while during a summer season said air conditioning unit can be activated to allow cold air to exit through said exhaust tubes to keep the players cool.

* * * * *